US005400910A

United States Patent [19]

Luebke

[11] Patent Number: 5,400,910

[45] Date of Patent: Mar. 28, 1995

[54] STABILIZING MECHANISM FOR OVERHEAD CRANE HOIST

[75] Inventor: Roger D. Luebke, Hartford, Wis.

[73] Assignee: Harnischfeger Corporation, Brookfield, Wis.

[21] Appl. No.: 999,615

[22] Filed: Dec. 31, 1992

[51] Int. Cl.[6] ..... B66C 13/06

[52] U.S. Cl. ..... 212/104; 212/213

[58] Field of Search ..... 212/102, 103, 104, 105, 212/213, 152, 215

[56] References Cited

U.S. PATENT DOCUMENTS

| | | | |
|---|---|---|---|
| 400,188 | 3/1889 | Brown | 212/104 |
| 764,329 | 7/1904 | Aiken | 212/152 |
| 2,306,055 | 12/1942 | Harry | 212/215 |
| 2,400,299 | 5/1946 | Jones | 212/152 |
| 2,902,177 | 9/1959 | Stoddard et al. | 212/192 |
| 3,367,606 | 2/1968 | Troxell | 212/105 |
| 3,391,906 | 7/1968 | Duerst | 212/152 |
| 3,794,185 | 2/1974 | Kroll et al. | 212/105 |
| 4,280,628 | 7/1981 | Goss et al. | 212/152 |

FOREIGN PATENT DOCUMENTS

| | | | |
|---|---|---|---|
| 756901 | 4/1967 | Canada | 212/215 |
| 1221199 | 3/1986 | U.S.S.R. | 212/152 |

*Primary Examiner*—Michael S. Huppert
*Assistant Examiner*—Thomas J. Brahan
*Attorney, Agent, or Firm*—Michael, Best & Friedrich

[57] ABSTRACT

An overhead crane apparatus including a hoist supported on a trolley. The hoist includes a bottom block with a pair of horizontally extending first and second trunnions. The overhead crane apparatus also includes an automatic mechanism for releasably securing the bottom block to the trolley. The mechanism includes first and second bottom block support plates having therein respective first and second downwardly opening notches. The mechanism also includes first and second hooks and fluid actuated cylinder/piston assemblies for biasing the hooks toward latched positions wherein the hooks overlap the first and second notches, respectively. When the bottom block is raised the first and second trunnions enter the associated first and second notches and cam the hooks to unlatched positions responsive to movement of the bottom block to a secured position. The hooks then return to their latched positions to prevent the trunnions from moving downwardly out of the notches to thereby secure the bottom block.

15 Claims, 4 Drawing Sheets

STABILIZING MECHANISM FOR OVERHEAD CRANE HOIST

BACKGROUND OF THE INVENTION

1. Field of the Invention

The invention relates to an overhead crane including a hoist for raising and lowering loads, and more particularly to arrangements for supporting and stabilizing loads lifted by the hoist to an overhead position.

2. Reference to Prior Art

An overhead crane includes a pair of parallel runways, a pair of bridge girders supported on rollers for movement along the runways, and a trolley supported on rollers for movement along the girders. A motor driven hoist is mounted on the trolley to raise and lower loads. The hoist includes a bottom block suspended from the trolley by cables. The block includes a load-carrying hook. A disadvantage associated with a conventional hoist construction is the potential for loads suspended from the trolley by the cables to sway or become unstable when the trolley is moved.

Current safety standards, at least in some crane applications, require the load to be secured directly to the crane, rather than being suspended by the cables, before the crane moves when personnel are below the crane. Heretofore, this has been done by hoisting the load onto hooks spanning the length of the girders. The girders can then be moved back and forth along the runways to reposition the load. However, to move the load from side to side along the girders, it is necessary to carefully lift the load from the hooks and then move the trolley to the desired new position relative to the girders before again placing the load on the hooks.

SUMMARY OF THE INVENTION

The present invention provides an overhead crane apparatus including a hoist and an improved mechanism for supporting and stabilizing loads lifted by the hoist. The mechanism is operable to automatically lock the bottom block of the hoist in a secured position relative to the trolley when the load is raised overhead. This eliminates the need for the hooks of the above-described prior art arrangement. Once the bottom block is secured to the trolley, the trolley can move along the girders with operating personnel below. Thus, the operator has complete freedom of movement after securing the load a single time.

The overhead crane apparatus of the present invention is suitable for use, for example, in a metal smelting operation in which metal compounds are reduced in an electrolytic bath to produce molten metal. In that operation an overhead crane is employed to service and maintain smelting furnaces by manipulating loads such as metal ore buckets, crucibles filled with molten metal, bath covers, and the like.

More particularly, the invention provides an overhead crane apparatus including a hoist supported on a trolley and including a bottom block with a pair of horizontally extending first and second trunnions. The overhead crane apparatus also includes means for releasably securing the bottom block to the trolley. The releasable securing means includes first and second bottom block support plates on the trolley. The first and second support plates have therein respective first and second downwardly opening notches. The releasable securing means also includes movable first and second hooks and fluid actuated cylinder/piston assemblies or other suitable means for biasing the hooks toward latched positions wherein the hooks overlap the first and second notches, respectively. When the bottom block is raised the first and second trunnions enter the associated notches and engage the bottom surfaces of the associated hooks. Further upward movement of the bottom block causes the trunnions to cam the hooks toward unlatched positions to allow passage of the trunnions upwardly into the notches to clear the hooks. The hooks then, under the influence of the cylinder/piston assemblies, return to their latched positions to prevent the trunnions from moving downwardly out of the notches to thereby secure the bottom block.

To release the bottom block to permit the lowering of the load, the hoist operator raises the bottom block slightly to remove the trunnions from the hooks. The operator then actuates the cylinder/piston assemblies to move the hooks to their unlatched positions so that the bottom block is free to move downwardly.

Other features and advantages of the invention will become apparent to one skilled in the art upon review of the following detailed description claims and drawings.

Figure 1:
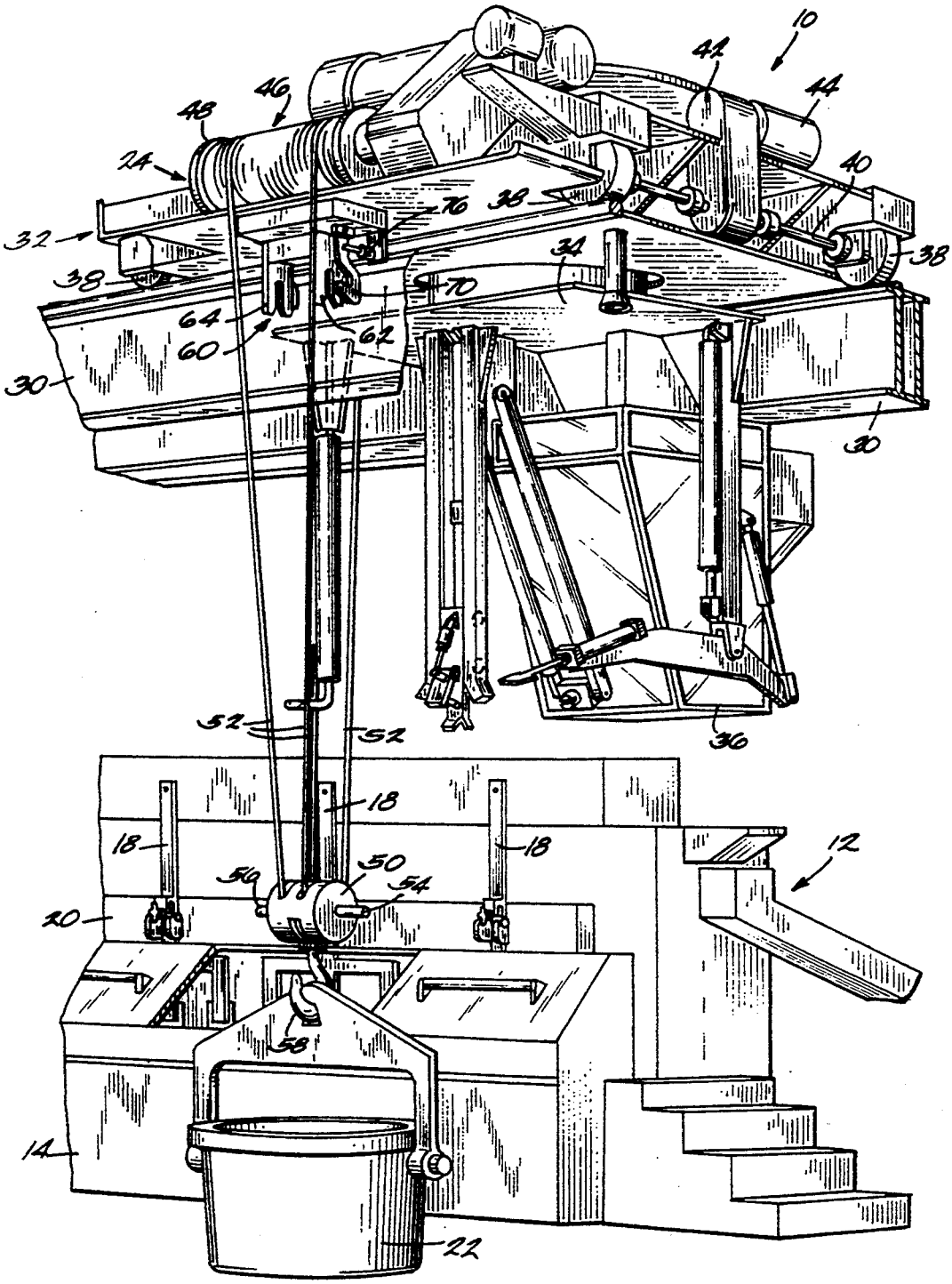
FIG. 1 is a perspective view of an overhead crane apparatus embodying the invention and shown in combination with a smelting apparatus.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Figure 2:
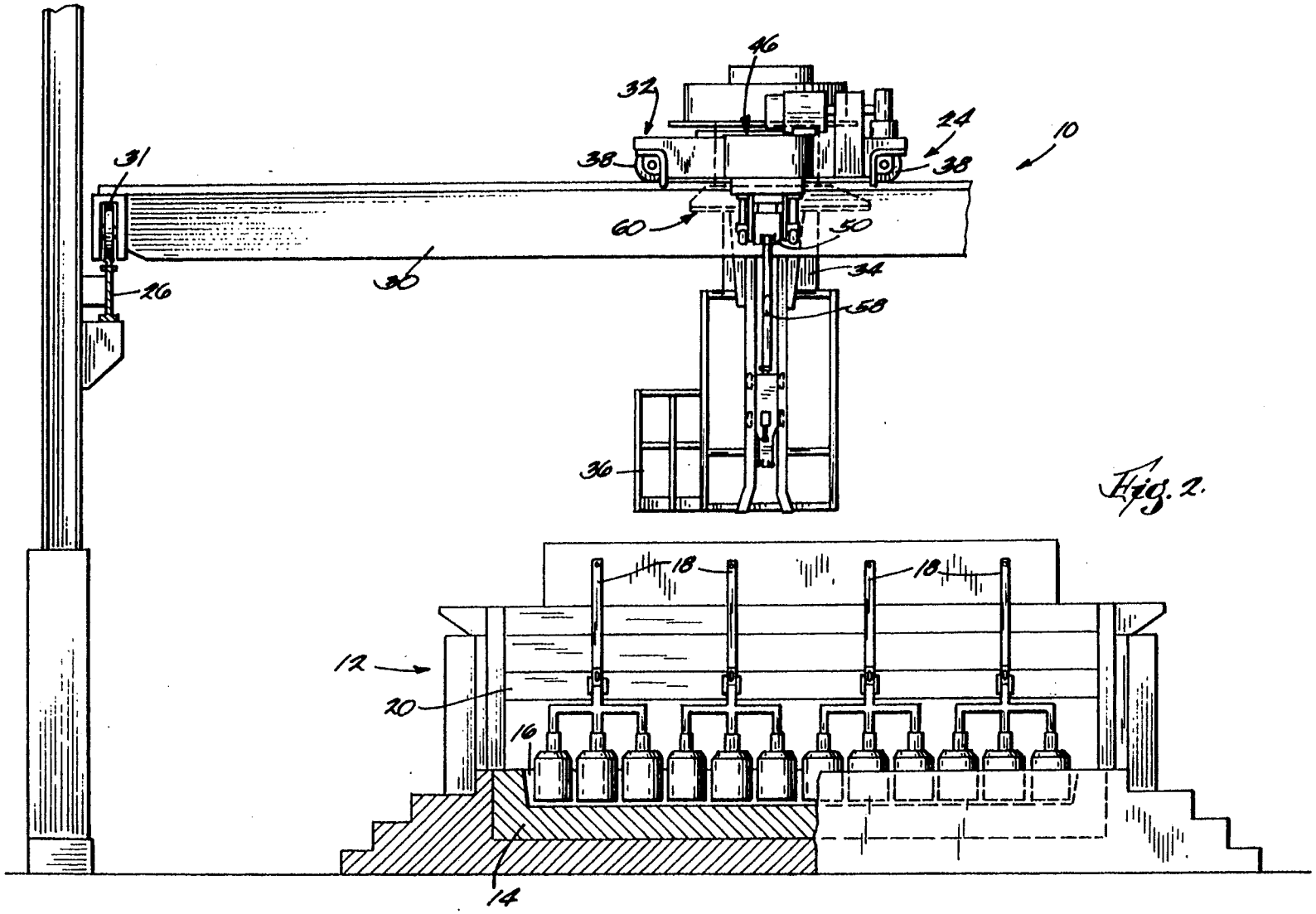
FIG. 2 is a reduced elevational view, partially in section, of a portion of the overhead crane apparatus and smelting apparatus illustrated in FIG. 1.

Illustrated in FIG. 1 is a portion of an overhead crane apparatus 10 embodying the invention. While the crane apparatus 10 can be used in a variety of applications, in the illustrated arrangement it is employed in an aluminum smelting operation to service a battery of smelting furnaces 12 (one is shown). As shown in FIG. 2, the smelting furnace 12 includes a pot 14 which acts as a cathode and which contains an electrolyte bath 16. The smelting furnace 12 also includes a plurality of anode assemblies 18 supported on a horizontal bus bar 20. The bus bar 20 is supplied with an electric current to electrolytically reduce alumina ($Al_2O_3$) to aluminum via an oxidation-reduction reaction. The molten aluminum produced by the reaction settles to the bottom of the pot 14 and is syphoned into crucibles 22 (one is shown in FIG. 1).

The crane apparatus 10 comprises an overhead crane 24 and a power source (not shown) for the crane 24. The crane 24 includes (see FIG. 2) a pair of spaced apart, parallel runways 26 (only one is shown). The runways 26 extend horizontally on opposite sides of the smelting furnaces 12. The crane 24 also includes a pair of parallel, spaced apart bridge girders 30 extending horizontally and perpendicularly between the runways 26. Means such as motor driven rollers 31 (only one is shown) mounted adjacent the ends of the girders 30 are provided for moving the girders 30 along the runways 26. The crane 24 also includes a trolley 32 extending between the girders 30. The trolley 32 includes a downwardly extending frame 34 and an operator cab 36 supported on the frame 34. The trolley 32 also includes rollers 38 generally positioned at its four corners to support it for rolling movement along the girders 30. Means are provided for moving the trolley 32 along the girders 30. In the illustrated arrangement the moving means includes a driven shaft 40 (FIG. 1) which drives a pair of the rollers 38 and which is driven via a suitable transmission 42 by an electric motor 44.

The overhead crane apparatus 10 also comprises a hoist 46 supported on the trolley 32. The hoist 46 includes a motor driven drum 48 rotatably supported on the trolley 32. A bottom block 50 is supported by the hoist 46 for vertical movement relative to the trolley 32. Specifically, cables 52 are reeved around the drum 48 and the block 50 is suspended from the cables 52 so that the bottom block 50 is raised or lowered depending upon the operator controlled direction of rotation of the drum 48. Means such as a hook 58 on the block 50 are provided for supporting loads such as the crucible 22. The crane apparatus 10 as thus far described is conventional and need not be described in greater detail.

The overhead crane apparatus 10 also comprises means separate from the hoist 46 for releasably securing a load to the trolley 32. While various securing means can be employed, in the illustrated arrangement such means includes means for securing the bottom block 50 to the trolley 32. To this end, the bottom block 50 includes oppositely projecting trunnions 54 and 56 extending generally horizontally from the end faces of the block 50, and the trolley 32 has mounted thereon (see FIGS. 3–5) a block support apparatus 60 engageable with the trunnions 54 and 56.

The block support apparatus 60 includes a pair of spaced apart bottom block support plates 62 and 64 extending downwardly from the trolley 32. The support plates 62 and 64 have therein respective downwardly opening notches 66 and 68. As is further explained below, the trunnions 54 and 56 are receivable in the notches 66 and 68, respectively.

Figure 4:
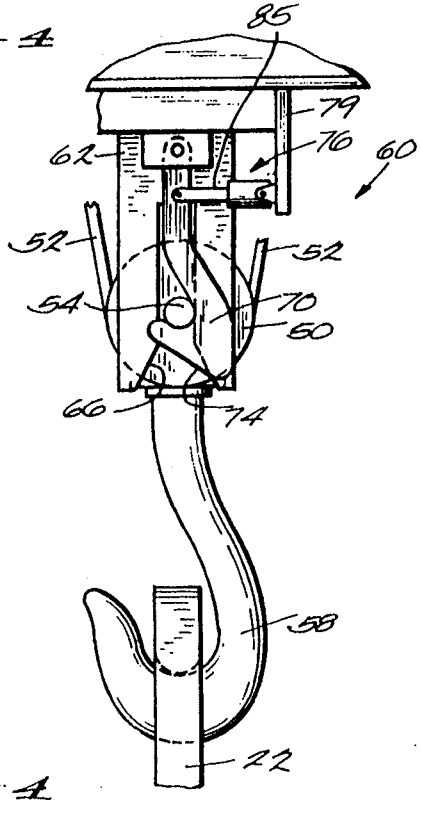
FIG. 4 is a side view taken along 4-4 in FIG. 3 and showing the bottom block in a secured position.
Figure 3:
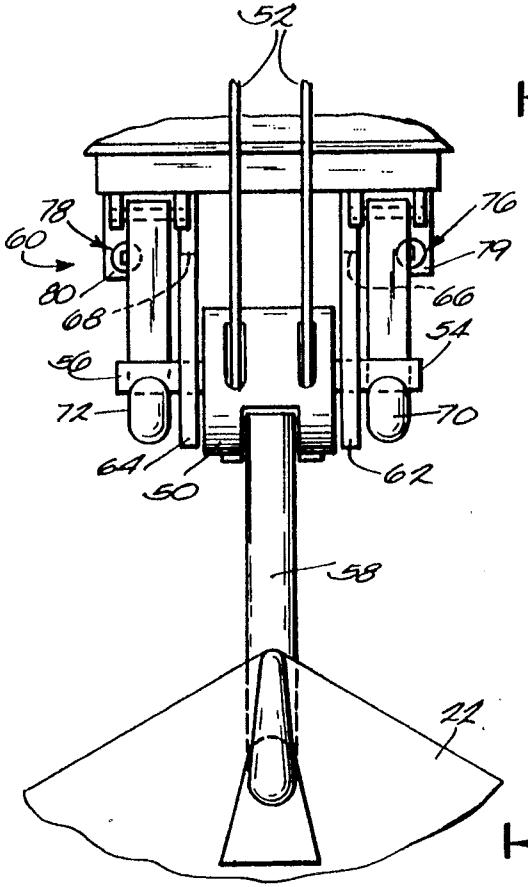
FIG. 3 is an enlarged portion of FIG. 1 showing part of a load support apparatus for the hoist.

The block support apparatus 60 also includes means for automatically securing the bottom block 50 to the trolley 32 when the bottom block 50 is moved to a secured position (FIGS. 3 and 4). While various automatic securing means can be employed, in the illustrated arrangement such means includes a pair of hooks 70 and 72 pivotally supported on the trolley 32 adjacent the support plates 62 and 64, respectively. The hooks 70 and 72 are each movable relative to the trolley 32 between a latched position (FIG. 4) in which the hooks 70 and 72 overlap the associated notches 66 and 68 (when viewed from the side as in FIG. 4) and an unlatched position (FIG. 5) in which the hooks 70 and 72 do not overlap the notches 66 and 68. In the latched position, the hooks 70 and 72 extend below the trunnions 54 and 56 when the bottom block 50 is in the secured position to prevent the trunnions 54 and 56 from moving downwardly out of the notches 66 and 68. In the unlatched position, the hooks 70 and 72 allow downward movement of the bottom block 50 from its secured position.

Figure 5:
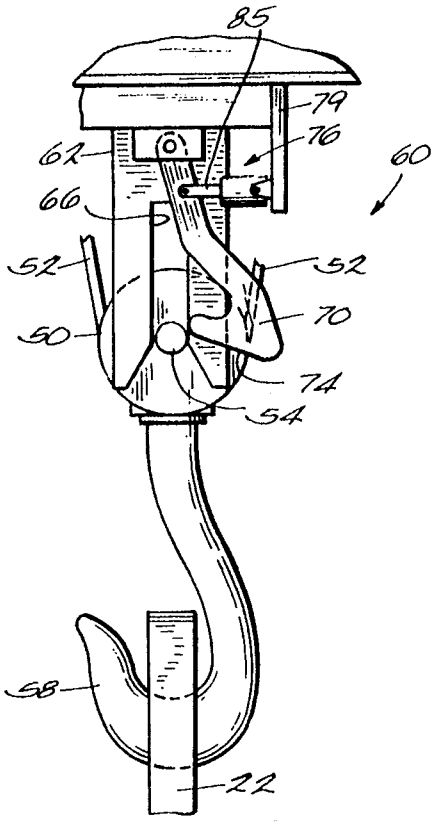
FIG. 5 is a view similar to FIG. 4 and showing the bottom block in an unsecured position.

To allow the bottom block 50 to be raised to its secured position, means are provided for moving the hooks 70 and 72 from their latched positions to their unlatched positions in response to movement of the block 50 to its secured position. While various hook moving means can be employed, in the illustrated arrangement each of the hooks 70 and 72 is provided with a bottom camming surface 74 that angles downwardly from left to right as viewed in FIG. 4. As the bottom block 50 is raised to its secured position, as shown in FIG. 5, engagement of the upwardly moving trunnions 54 and 56 with the bottom surfaces 74 causes the hooks 70 and 72 to pivot toward their unlatched positions to allow further upward passage of the trunnions 54 and 56.

The block support apparatus 60 also includes means for returning the hooks 70 and 72 to their latched positions after the bottom block 50 reaches its secured position, and selectively operable means for moving the hooks 70 and 72 from their latched positions to their unlatched positions to allow movement of the bottom block 50 downwardly from its secured position. In the illustrated arrangement, both means include a pair of fluid-operated, double-acting cylinder/piston assemblies 76 and 78 for biasing the hooks 70 and 72 toward their latched positions. The cylinder/piston assemblies 76 and 78 are respectively supported on brackets 79 and 80 that extend downwardly from the trolley 32. The cylinder/piston assemblies 76 and 78 each include (see FIG. 6) a cylinder 81 pivotally connected to the associated bracket 79 or 80, a piston 82 dividing the cylinder 81 into inner and outer chambers 83 and 84, and a piston rod 85 which extends from the piston 82 and which is pivotally connected at its free end to the associated hook 70 or 72.

Figure 6:
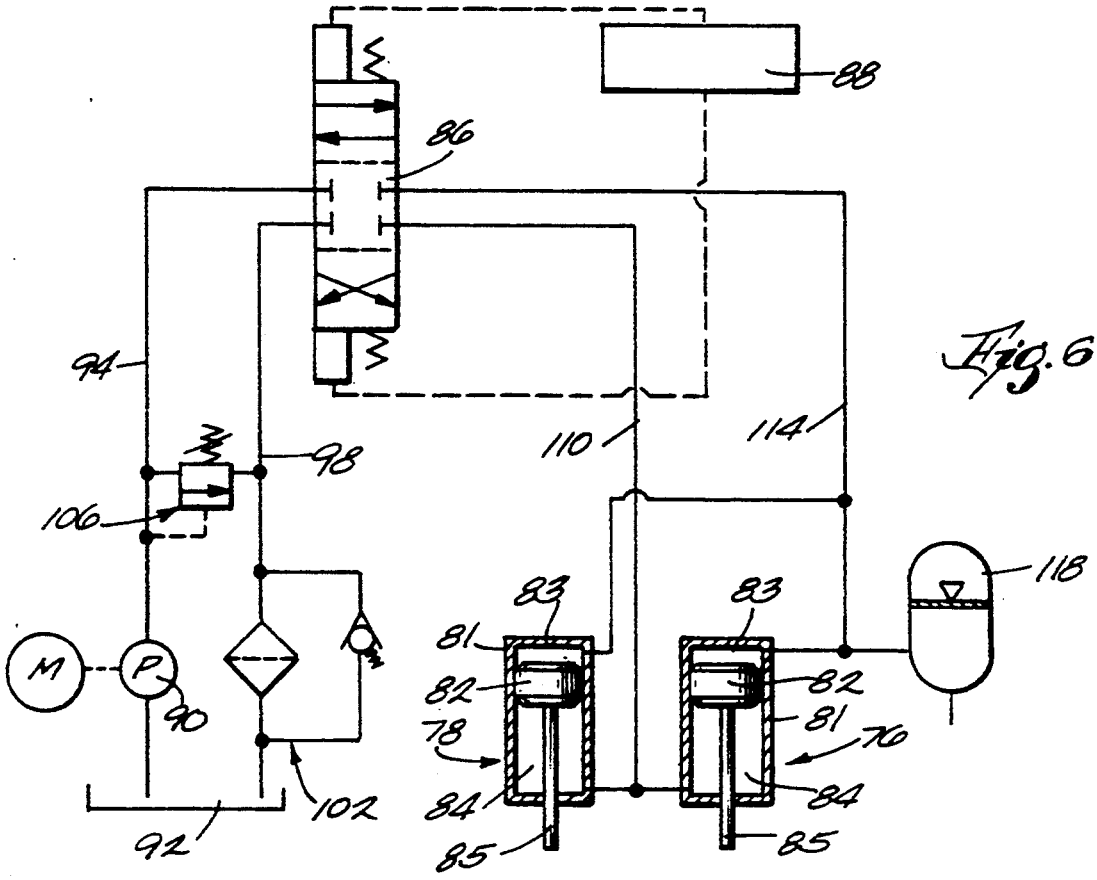
FIG. 6 is a partial schematic view of the control system of the crane apparatus.

A hydraulic system actuates the cylinder/piston assemblies 76 and 78. The hydraulic system includes an operator actuated, spring centered directional valve 86. The valve 86 is selectively movable between a center position (shown in FIG. 6), a first or upper position, and a second or lower position. As shown in FIG. 6, the valve 86 is controlled by the operator via remote controls 88, which are located in the cab 36. The hydraulic system also includes a fixed displacement pump 90 which is driven by a motor and which supplies fluid under pressure from a sump 92 to a pressure line 94 communicating between the pump 90 and the valve 86. A return line 98 communicates between the valve 86 and the sump 92 and has therein a conventional filter arrangement 102. A conventional relief valve 106 communicates between the pressure line 94 and the return line 98. The hydraulic system also includes a line 110 communicating between the valve 86 and the outer chambers 84 of the cylinders 81, and a line 114 communicating between the valve 86 and the inner chambers 83 of the cylinders 81. The line 114 also communicates with a gas charged accumulator 118, for reasons explained below.

When the valve 86 is in its center position, the pressure line 94, the return line 98, the line 110 and the line 114 are all closed off at the valve 86. The accumulator 118 pressurizes the inner chambers 83 of the cylinders 81 and thereby biases the piston rods outwardly so as to bias the hooks 70 and 72 toward their latched positions. As described above, movement of the bottom block 50 to its secured position while the hooks 70 and 72 are in their latched positions causes the hooks 70 and 72 to pivot toward their unlatched positions, and this causes inward movement of the piston rods. Such movement of the piston rods causes fluid to flow out of the inner chambers 83 of the cylinders 81, and this fluid is absorbed by the accumulator 118. After the bottom block 50 has reached its secured position and the hooks 70 and 72 are free to return to their latched positions, the gas pressure in the accumulator 118 causes the fluid previously absorbed by the accumulator 118 to return to the cylinders 81. This causes extension of the piston rods and thereby causes the hooks 70 and 72 to return to their latched positions.

When the valve 86 is in its upper position, the pressure line 94 communicates with the line 110 and the return line 98 communicates with the line 114. As a result, fluid under pressure is supplied to the outer chambers 84 of the cylinders 81, thereby causing retraction of the piston rods, and fluid from the inner chambers 83 of the cylinders 81 flows to the sump 92 via the line 114 and the return line 98. Thus, movement of the valve 86 to its upper position causes movement of the hooks 70 and 72 from their latched positions to their unlatched positions.

When the valve 86 is in its lower position, the pressure line 94 communicates with the line 114 and the return line 98 communicates with the line 110. As a result, fluid under pressure is supplied to the inner chambers 83 of the cylinders 81, and fluid flows from the outer chambers 84 of the cylinders 81 to the sump 92 via the line 110 and the return line 98. This causes extension of the piston rods 85.

The overhead crane apparatus 10 is preferably further provided with hoist control means for slowing operation of the hoist 46 as the trunnions 54 and 56 enter the associated notches 66 and 68 and for stopping the hoist 46 when the bottom block 50 reaches its secured position. Various control means such as a conventional geared limit switch (not shown) incorporated into the hoist 46 can be employed to control hoist speed.

To operate the hoist 46, the trolley 32 is positioned above a load such as the crucible 22. After securing the crucible 22 on the hook 58, the hoist 46 is operated to raise the crucible 22. As the bottom block 50 approaches the limit of its upward movement, the trunnions 54 and 56 enter the notches 66 and 68 and engage the bottom camming surfaces 74 of the hooks 70 and 72. Further upward movement of the bottom block 50 and the camming action of the trunnions on the hook surfaces 74 causes the hooks 70 and 72 to pivot to their unlatched positions against the resistance of the cylinder/piston assemblies 76 and 78 to permit the bottom block 50 to ascend to its secured position. After the trunnions 54 and 56 clear the hooks 70 and 72, the cylinder/piston assemblies 76 and 78 return the hooks 70 and 72 to their latched positions to prevent the bottom block 50 from moving downwardly. The bottom block is then lowered slightly until the trunnions rest on the hooks 70 and 72. The bottom block 50 is held in its secured position by the block support apparatus 60 so as to support and stabilize the crucible 22 even as the trolley 32 is moved back and forth or from side to side relative to the smelting furnaces 12.

To lower the crucible 22, the bottom block 50 is raised slightly to withdraw the trunnions 54 and 56 from the hooks 70 and 72. The cylinder/piston assemblies 76 and 78 are then actuated to retract the piston rods 85 to pivot the hooks 70 and 72 to their unlatched positions so that the bottom block 50 can be freely lowered.

Other features and advantages of the invention are set forth in the following claims.

I claim:

1. Overhead crane apparatus for handling a load, said apparatus comprising:

a trolley, means on said trolley for raising and lowering the load, said means including a bottom block supported by said trolley for upward and downward movement relative to said trolley and relative to a secured position, and means on said bottom block for supporting the load, a hoist for moving said bottom block upwardly and downwardly relative to said trolley, and means separate from said hoist for releasably securing said bottom block to said trolley, said securing means including a hook movable between a latched position wherein said hook secures said bottom block to said trolley when said bottom block is in said secured position, and an unlatched position wherein said hook allows movement of said bottom block to and from said secured position, means for moving said hook from said latched position to said unlatched position in response to movement of said bottom block to said secured position, and means for automatically returning said hook to said latched position after said bottom block moves to said secured position, said returning means including a cylinder/piston assembly connected to said hook for biasing said hook toward said latched position.

2. Apparatus as set forth in claim 1 and further comprising selectively operable means for moving said hook from said latched position to said unlatched position so that said bottom block can be moved from said secured position.

3. Apparatus as set forth in claim 2 wherein said returning means and said selectively operable means both include said cylinder/piston assembly.

4. Apparatus as set forth in claim 3 wherein said cylinder/piston assembly includes a cylinder connected to said trolley, a piston dividing said cylinder into inner and outer chambers, and a piston rod extending through said outer chamber and having an outer end connected to said hook, and wherein said apparatus also comprises a hydraulic system for actuating said cylinder/piston assembly, said system including a gas charged accumulator communicating with said inner chamber so that said hook is biased to said latched position, and a pump selectively communicable with said outer chamber for moving said hook from said latched position to said unlatched position.

5. Apparatus as set forth in claim 1 wherein said bottom block has thereon a projection, wherein said securing means includes a bottom block support plate which is supported by said trolley and which has therein a downwardly opening notch adapted to receive said projection, wherein said hook is movably supported adjacent said support plate and overlaps said notch when said hook is in said latched position so that said hook extends below said projection when said projection is located in said notch so as to prevent said projection from moving downwardly out of said notch, and wherein said hook is out of overlapping relationship with said notch when said hook is in said unlatched position so as to allow passage of said projection into and out of said notch.

6. Apparatus as set forth in claim 5 and further comprising selectively operable means for moving said hook from said latched position to said unlatched position so that said bottom block can be moved from said secured position.

7. Apparatus as set forth in claim 6 wherein said selectively operable means includes said cylinder/piston assembly.

8. Apparatus as set forth in claim 1 wherein said bottom block has thereon oppositely and horizontally extending first and second trunnions, and wherein said securing means includes first and second bottom block support plates which are supported by said trolley and which have therein respective first and second downwardly opening notches adapted to respectively receive said first and second trunnions, and a second hook, each of said hooks being movably supported by said trolley adjacent said first and second support plates, respectively, each of said hooks being movable to said latched position wherein the hook overlaps the notch in the associated support plate and extends below the associated trunnion when the associated trunnion is located in the associated notch so as to prevent the associated trunnion from moving downwardly out of the associated notch, each of said hooks also being movable to said unlatched position wherein the hook is out of overlapping relationship with the associated notch so as to allow passage of the associated trunnion upwardly into the associated notch, and each of said hooks moving from said latched position to said unlatched position in response to engagement by the associated trunnion as the associated trunnion moves upwardly into the associated notch, and means for biasing each of said hooks toward said latched position so that the hook returns to said latched position after the associated trunnion moves past the hook and into the associated notch, said biasing means including said cylinder/piston assembly, and a second cylinder/piston assembly connected to said second hook.

9. Apparatus as set forth in claim 8 and further comprising hoist control means for slowing said hoist as said trunnions enter said notches and for stopping said hoist when said hooks return to said latched positions after said trunnions have moved into said notches.

10. Apparatus as set forth in claim 1 wherein said hoist is supported by said trolley.

11. Apparatus as set forth in claim 1 wherein said cylinder/piston assembly includes a cylinder connected to said trolley, a piston dividing said cylinder into inner and outer chambers, and a piston rod extending through said outer chamber and having an outer end connected to said hook, and wherein said apparatus also comprises a hydraulic system for actuating said cylinder/piston assembly, said system including a gas charged accumulator communicating with said inner chamber.

12. Overhead crane apparatus for handling a load, said apparatus comprising:

a trolley, a host supported by said trolley, a bottom block supported by said hoist for upward and downward movement relative to said trolley, said bottom block being movable relative to a secured position, a hook movable between a latched position wherein said hook secures said bottom block to said trolley when said bottom block is in said secured position, and an unlatched position wherein said hook allows movement of said bottom block to and from said secured position, said hook moving from said latched position to said unlatched position in response to movement of said bottom block to said secured position, and said hook automatically returning to said latched position after said bottom block moves to said secured position, hook means on said bottom block for supporting the bath cover, ore bucket, or crucible, and a selectively operable cylinder/piston assembly connected to said hook for biasing said hook toward said latched position so that said hook is returned to said latched position under the influence of said cylinder/piston assembly and for moving said hook from said latched position to said unlatched position so that said bottom block can be moved from said secured position.

13. Apparatus as set forth in claim 12 wherein said cylinder/piston assembly includes a cylinder connected to said trolley, a piston dividing said cylinder into inner and outer chambers, and a piston rod extending through said outer chamber and having an outer end connected to said hook, and wherein said apparatus also comprises a hydraulic system for actuating said cylinder/piston assembly, said system including a gas charged accumulator communicating with said inner chamber so that said hook is biased to said latched position, and a pump selectively communicable with said outer chamber for moving said hook from said latched position to said unlatched position.

14. Overhead crane apparatus for handling a load, said apparatus comprising:

an overhead crane including horizontal, parallel, spaced-apart runways, horizontal, parallel, spaced-apart bridge girders extending between and perpendicular to said runways, means for moving said bridge girders along said runways, a trolley extending between and supported by said bridge girders, and means for moving said trolley along said bridge girders, a hoist supported by said trolley, a bottom block supported by said hoist for upward and downward movement relative to said trolley, said bottom block having thereon oppositely and horizontally extending first and second trunnions, hook means for releasably securing said bottom block to said trolley, said hook means including first and second bottom block support plates which are supported by said trolley and which have therein respective first and second downwardly opening notches adapted to respectively receive said first and second trunnions, first and second hooks movably supported by said trolley adjacent said first and second support plates, respectively, each of said hooks being movable to a latched position wherein the hook overlaps the notch in the associated support plate and extends below the associated trunnion when the associated trunnion is located in the associated notch so as to prevent the associated trunnion from moving downwardly out of the associated notch, each of said hooks also being movable to an unlatched position wherein the hook is out of overlapping relationship with the associated notch so as to allow passage of the associated trunnion upwardly into the associated notch, and each of said hooks moving from said latched position to said unlatched position in response to engagement by the associated trunnion as the associated trunnion moves upwardly into the associated notch, and means for biasing each of said hooks toward said latched position so that the hook automatically returns to said latched position after the associated trunnion moves past the hook and into the associated notched, said biasing means including first and second cylinder/piston assemblies respectively connected to said first and second hooks, said cylinder/piston assemblies also being selectively operable to move said first and second hooks from said latched positions so as to allow said trunnions to move downwardly out of said notches, hoist control means for slowing said hoist as said trunnions enter said notches and for stopping said hoist when said hooks return to said latched positions after said trunnions have moved into said notches, and a hook which is supported by said bottom block and which is adapted to support the bath cover, or bucket, or crucible.

15. Apparatus as set forth in claim 14 wherein each of said cylinder/piston assemblies includes a cylinder connected to said trolley, a piston dividing said cylinder into inner and outer chambers, and a piston rod extending through said outer chamber and having an outer end connected to the associated hook, and wherein said apparatus also comprises a hydraulic system for actuating said cylinder/piston assemblies, said system including a gas charged accumulator communicating with said inner chamber of each of said assemblies so that said hooks are biased to said latched position, and a pump selectively communicable with said outer chamber of each of said assemblies for moving said hooks from said latched position to said unlatched position.

* * * * *